US006751963B2

(12) United States Patent
Navedo et al.

(10) Patent No.: US 6,751,963 B2
(45) Date of Patent: Jun. 22, 2004

(54) PORTABLE INSULATED CONTAINER WITH REFRIGERATION

(75) Inventors: Jose Enrique Navedo, Wichita, KS (US); James Michael Boenig, Seguin, TX (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/254,437

(22) Filed: Sep. 24, 2002

(65) Prior Publication Data

US 2004/0055313 A1 Mar. 25, 2004

(51) Int. Cl.[7] ..... F25B 9/00
(52) U.S. Cl. ..... 62/6; 62/457.9
(58) Field of Search ..... 62/6, 235.1, 457.1, 62/457.9

(56) References Cited

U.S. PATENT DOCUMENTS

| | | | | |
|---|---|---|---|---|
| 2,479,848 A | | 8/1949 | Mackey et al. | |
| 3,605,431 A | * | 9/1971 | Carson | 62/457.9 |
| 4,006,606 A | * | 2/1977 | Underdue | 62/457.9 |
| 4,058,384 A | * | 11/1977 | Keefe | 62/457.9 |
| 4,386,309 A | | 5/1983 | Peschka | |
| 4,658,599 A | * | 4/1987 | Kajiwara | 62/235.1 |
| 4,928,502 A | * | 5/1990 | Kumada et al. | 62/6 |
| 4,981,019 A | * | 1/1991 | Hicks et al. | 62/3.62 |
| 5,333,460 A | * | 8/1994 | Lewis et al. | 62/6 |
| 5,379,596 A | * | 1/1995 | Grayson | 62/457.9 |
| 5,438,848 A | * | 8/1995 | Kim et al. | 62/6 |
| 5,544,495 A | | 8/1996 | Anderson et al. | |
| 5,642,622 A | * | 7/1997 | Berchowitz et al. | 62/6 |
| 5,927,079 A | * | 7/1999 | Sekiya et al. | 62/6 |
| 5,987,904 A | | 11/1999 | Kim et al. | |
| 6,021,642 A | | 2/2000 | Guinn | |
| 6,266,963 B1 | * | 7/2001 | Rudick | 62/6 |
| 6,266,966 B1 | | 7/2001 | Fernandez et al. | |
| 6,282,906 B1 | | 9/2001 | Cauchy | |
| 2002/0005043 A1 | | 1/2002 | Rudick et al. | |

FOREIGN PATENT DOCUMENTS

| | | |
|---|---|---|
| DE | 2020205 | 11/1971 |
| EP | 0454491 A2 | 10/1991 |
| EP | 1167900 A1 | 1/2002 |
| JP | 03036468 | 2/1991 |
| JP | 2001-221553 A | 8/2001 |

OTHER PUBLICATIONS

Berchowitz, D.M., PhD., "Maximized Performance of Stirling Cycle Refrigerators" IIF—IIR—Sections B and E , Oslo, Norway (1998).

Berchowitz, D.M. Ph. D., "Stirling Coolers for Solar Refrigerators" International Appliance Technical Conference, Purdue University, West Lafayett, Indiana (May 13–15, 1996).

(List continued on next page.)

*Primary Examiner*—Denise L. Esquivel
*Assistant Examiner*—Malik N. Drake
(74) *Attorney, Agent, or Firm*—Leydig, Voit & Mayer, Ltd.

(57) ABSTRACT

An insulated container utilizing Stirling cooler technology. The insulated container and the Stirling cooler include a portable power source, such as a battery, a fuel cell, or a solar panel. The Stirling cooler may provide cooling to the inside of the insulated container, for example by a heat sink and a fan, direct connection to a liner in the insulated container, or a thermosyphon or heat pipe connected to the heat acceptor for the Stirling cooler and routed through the insulated container. Controls may be provided that regulate the cycling of the Stirling cooler so that the internal temperature of the insulated container may be controlled. An embodiment includes both a freezer portion and a refrigeration portion.

52 Claims, 6 Drawing Sheets

OTHER PUBLICATIONS

Berchowitz et al., "Design and Testing of a 40 W Free–Piston Stirling Cycle Cooling Unit", 20$^{th}$ International Congress of Refrigeration, IIIR/IIF , Sydney (1999).

Berchowitz et al., "Free—Piston Rankine Compression and Sterling Cycle Machines for Domestic Refrigeration", Greenpeace Ozone Safe Conference, Washington, DC (Oct. 18–19, 1993).

Berchowitz et al., Recent Advances in Sterling Cycle Refrigeration, printed from http://www.globalcooling.com/techpapers.html on Sep. 24, 2002 (document created Dec. 26, 1998).

Ewert, Michael K. et al., "Experimental Evolution of a Solar PV Refrigerator with Thermoelectric, Stirling and Vapor Compression Heat Pumps", printed from http://www.globalcooling.com/techpapers.html on Sep. 24, 2002 (document created Jul. 5, 1998).

Karandikar, A. et al. : "Low Cost Small Cryocoolers for Commercial Applications" 1995 Cryogenic Engineering Conference, Columbus Ohio, printed from http://www.sunpower.com/tech_papers/pub95/cryo95.html on Jul. 28, 1999 (Jul. 17–21, 1995).

Kim, Seon–Young et al, : "The Application of Stirling Cooler to Refrigeration", printed from http://www.globalcooling.com/techpapers.html on Sep. 24, 2002 (document created Apr. 25, 1999).

McDonald, Kelly, Stirling Refrigerator for Space Shuttle Experiments, 29$^{th}$ Intersociety Energy Conference, Monterrey, California (Aug. 7–11, 1994).

Oguz, Emre et al. An Experimental Study on the Refrigeration Capacity and Thermal Performance of Free Piston Stirling Coolers, printed from http://www.globalcooling.com/techpapers.html on Sep. 24, 2002 (document created Sep. 12, 2000).

* cited by examiner

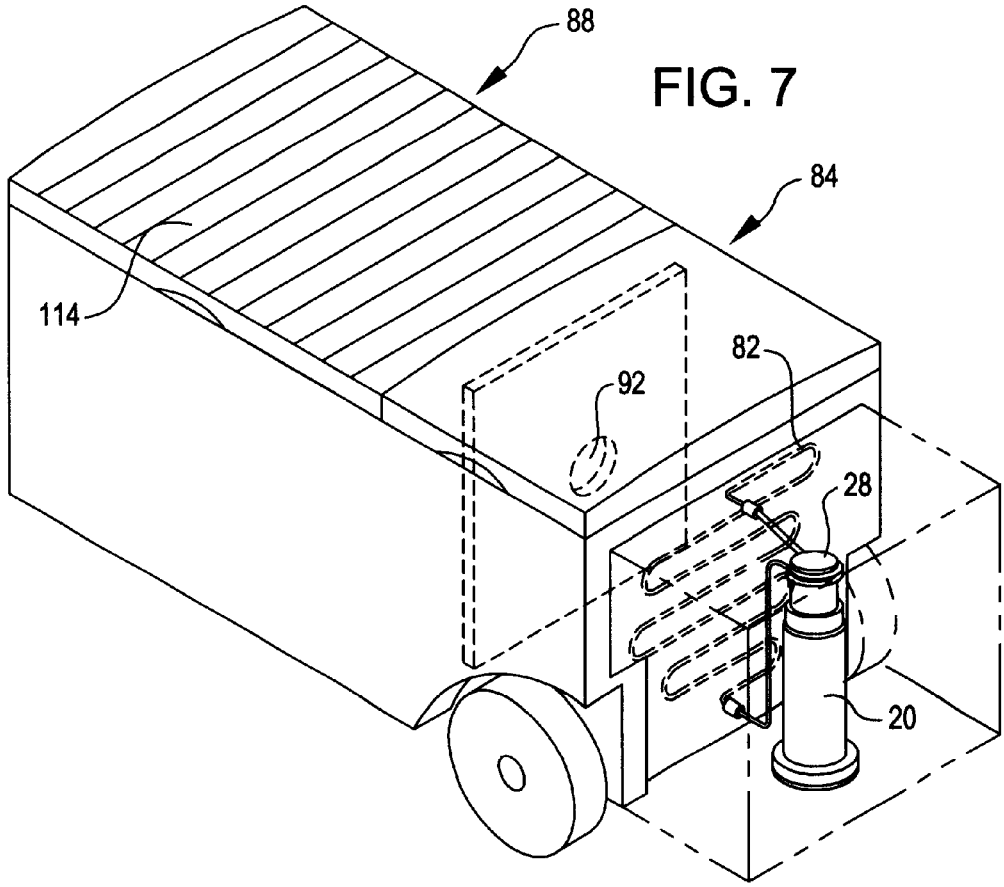
FIG. 7
FIG. 8
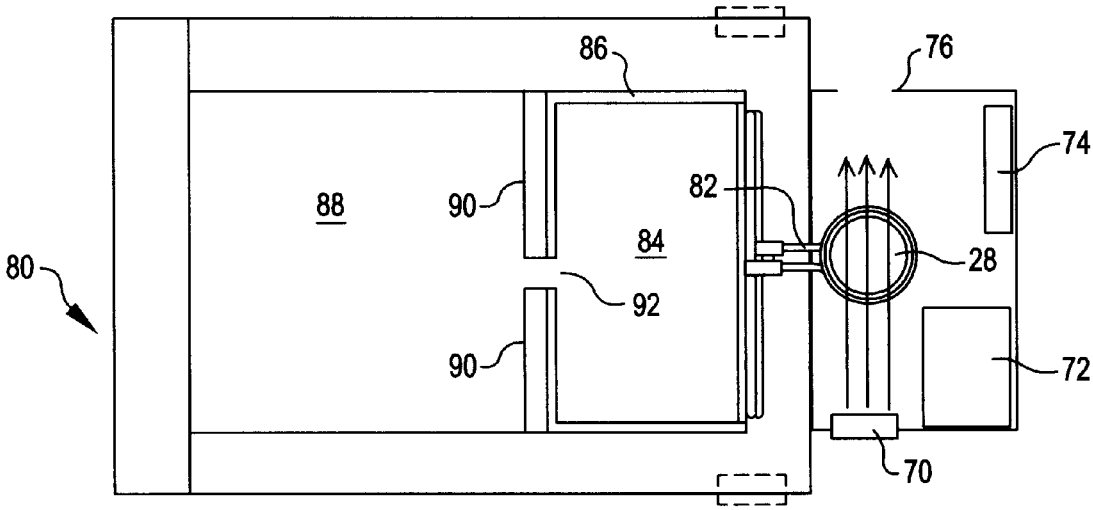

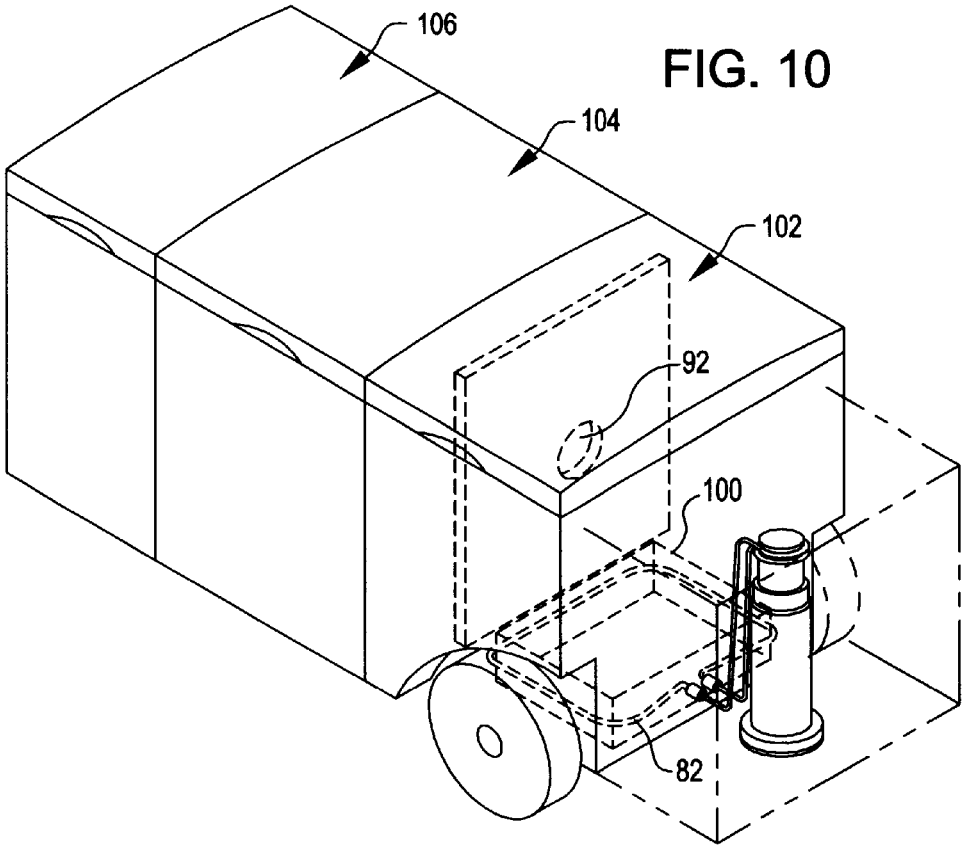
FIG. 10
FIG. 12
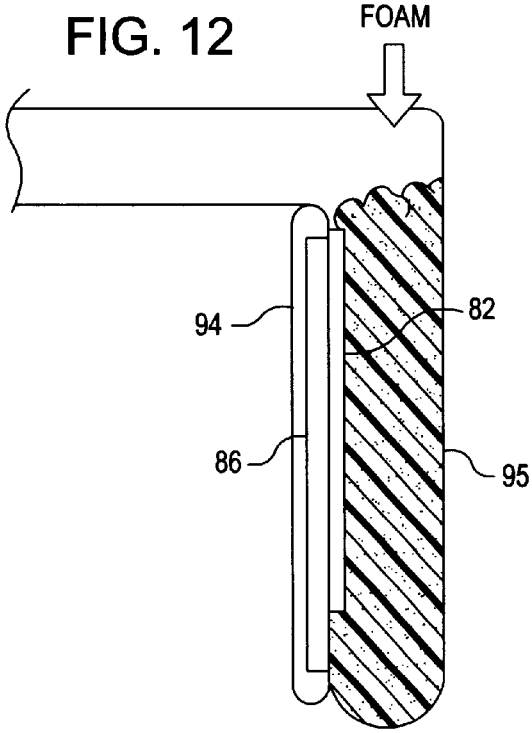
FIG. 13
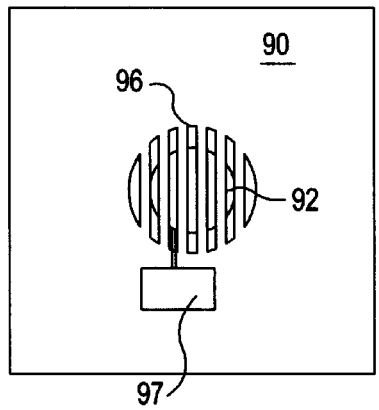

PORTABLE INSULATED CONTAINER WITH REFRIGERATION

TECHNICAL FIELD OF THE INVENTION

The present invention generally relates to insulated containers, and more specifically relates to insulated containers having refrigeration units.

BACKGROUND OF THE INVENTION

Insulated containers, also called "coolers," are prevalent in contemporary life. The insulated containers are often used for picnics or for outdoor activities such as camping or sporting events. In addition, insulated containers are becoming more prevalent in the medical industry, where they are used to move transplant organs and other articles that need to remain cold during transport. Also, the need to transport commercial goods such as perishable food, drink, medicine, and environmental samples is becoming more important.

One downside to current insulated containers is that the length of time that an insulated container can keep something cold is limited. For example, if ice is used in the insulated container, the ice will often melt because the cooler cannot maintain the colder interior temperatures needed to prevent melting of the ice. Frozen ice packs do not last much longer. Traditional vapor cycle systems, while efficient, are quite large and heavy. Most of these systems require a 110-volt outlet to operate. A few 12 volt or 24 volt systems are available today; however, these systems are also large and heavy. The vapor cycle 12 and 24-volt systems also may have problems with vibrations during transportation. In addition, there exists absorption and adsorption refrigerators, but these fail if enough vibrations exist and improper orientation may also cause the units to fail. Like the vapor cycle refrigerators, these cooler systems are heavy, and must use ammonia in order to freeze.

Another downside to insulated containers is that they often cannot be maintained at freezing temperatures for very long. To solve this problem, many companies often use dry ice to keep the contents of an insulated container cold. However, even dry ice has time limitations, and its use and handling is difficult.

One solution that has recently been used for providing insulated containers that can maintain cold temperatures for long periods of time is to provide refrigeration units as components of the insulated containers. Such refrigeration units typically must be plugged into an AC outlet or a car cigarette lighter to provide cooling. While such a cooling unit works well for cooling items in the insulated container, an AC outlet or similar power supply is not always readily available.

SUMMARY OF THE INVENTION

The present invention provides an insulated container utilizing Stirling cooler technology. In accordance with one aspect of the present invention, the insulated container and the Stirling cooler include a self-contained, portable power source associated with them. For example, the portable power source may be a battery, a fuel cell, a flexible solar panel, a Stirling generator, or a combustion engine generator.

In accordance with another aspect of the present invention, the Stirling cooler may provide cooling to the insulated container in a number of different ways. As one example, a heat sink may be attached to a cold portion (i.e., heat acceptor portion) of the Stirling cooler and a fan may blow through the heat sink and into the insulated interior portion of the cooler, thus providing refrigeration. In another example, a heat pipe or a thermosyphon may be attached to the heat acceptor portion of the Stirling cooler and the working fluid of the thermosyphon (e.g., water) may be circulated from the heat acceptor of the Stirling cooler into the insulated container. In one embodiment, the heat pipe or thermosyphon is arranged as a series of coils on the inside of the compartment to be cooled, and the Stirling cooler is located on the outside of that compartment. In another embodiment, the heat pipe or the thermosyphon extends around a lower portion of the cooler, and includes a metal liner adjacent thereto. Alternatively, the heat pipe or thermosyphon may be arranged around a top portion of the cooler, with a metal liner adjacent thereto. The heat pipe may also be attached to a metal plate that is externally attached to the inner liner of a cooler then foamed into place. This method provides an insulated container having an interior that is easy to clean.

In accordance with another aspect of the present invention, if the heat sink and fan are used, the insulated container provides refrigeration only. However, if the heat pipe or thermosyphon is used, the cycling of the Stirling cooler may be increased so that the same insulated container may also be used simultaneously as a freezer. Controls may be provided that regulate the cycling of the Stirling cooler so that the internal temperature of the insulated container may be controlled. If desired, the cycling of the Stirling cooler may be changed so that the heat acceptor regulates temperature sufficiently to permit an insulated container having a heat pipe or a thermosyphon to be used alternatively as a refrigerator or a freezer.

In accordance with still another aspect of the present invention, an insulated container using the heat pipe or thermosyphon to provide a freezer portion may additionally include a separate chamber within the insulated container that provides refrigeration. In accordance with one aspect of this embodiment of the present invention, a small adjustable or fixed opening is provided between the freezer portion and the refrigerator portion. Cold air flows from the freezer portion into the refrigerator portion, providing sufficient cooling to provide refrigeration. Alternatively, instead of a small hole, insulation between the two compartments may be sufficiently thin such that thermal transfer is provided between the two containers. Still another compartment may be provided that is insulated from the freezer and/or refrigerator compartments and that is not refrigerated or cooled at all. Yet another insulated container may utilize heat from the hot portion (heat rejecter side) of the Stirling cooler for warming or heating a compartment.

In accordance with another aspect of the present invention, a heat sink is provided on the hot portion (heat rejecter side) of the Stirling cooler. This heat sink and the hot portion of the Stirling cooler may be mounted on the outside of the insulated container. If mounted inside, they are mounted in a separate compartment from the cooled compartment or compartments. A fan is provided for conducting heat away from the heat sink attached to the heat rejecter of the Stirling cooler. If mounted inside a compartment, a hole may be provided in the side of the cooler for permitting the hot air to flow out of the cooler.

The Stirling cooler of the present invention provides a portable refrigeration or freezing unit that requires very little energy input. The unit may provide heating, ambient, refrigeration, or freezing, or any combination thereof, each with a specific compartment. In addition, because the invention uses Stirling technology, the refrigeration unit is nonpolluting, quiet, lightweight, and efficient.

Other advantages will become apparent from the following detailed description when taken in conjunction with the drawings, in which:

BRIEF DESCRIPTION OF THE DRAWINGS

FIG. 7 is a perspective view of an insulated container having a Stirling cooler similar to the Stirling cooler of FIG. 1 installed therein, with a thermosyphon leading from the Stirling cooler to a compartment in the insulated container;

FIG. 8 is a schematic top view of the insulated container of FIG. 7;

FIG. 10 is a perspective view showing an alternate embodiment of an insulated container in accordance with the present invention, the alternate embodiment including a Stirling cooler similar to the Stirling cooler of FIG. 1 and having a heat pipe extending along a bottom portion of a compartment of the insulated container;

FIG. 12 is a top view showing a method for forming an insulated container in accordance with one aspect of the present invention; and FIG. 13 is an end view showing a center wall of an insulated container, the center wall including louvers in accordance with one aspect of the present invention.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention. In addition, to the extent that orientations of the invention are described, such as "top," "bottom," "front," "rear," and the like, the orientations are to aid the reader in understanding the invention, and are not meant to be limiting.

Figure 1:
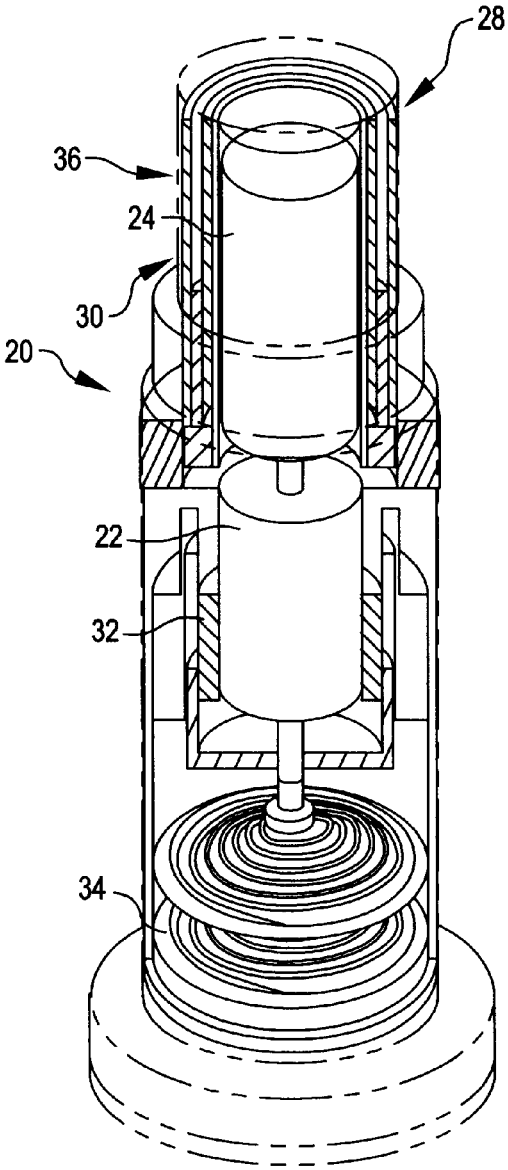
FIG. 1 is a partial cut-away perspective view that schematically represents the components of a Stirling cooler that may be used with the present invention.

Referring now to the drawings, in which like reference numerals represent like parts throughout the several views, FIG. 1 shows a Stirling cooler that may be used with the present invention. Stirling coolers are known in the art and are developed by, for example, Global Cooling, Inc., of Athens, Ohio. Although Stirling coolers are known, a brief description is provided herein for the convenience of the reader.

In general, a Stirling cooler (e.g., the Stirling cooler 20) includes a hermetically sealed capsule that contains a small amount of a working fluid, such as helium. The capsule contains two moving components: a piston 22 and a displacer 24. The piston 22 is driven back and forth by an AC linear motor 26.

The Stirling cooler cycle starts with AC input to the linear motor 26. This input drives a magnet ring 32 which is rigidly attached to the piston 22. The piston 22 is driven by the linear motor 26 because the piston 22 is rigidly attached to the moving magnet ring 32. The oscillating motion of the piston 22 compresses and expands the working fluid.

The displacer 24 is free floating in the upper portion of the Stirling cooler 20. This upper portion is called the regenerator 36. The working fluid is free to flow back and forth around the displacer 24. The displacer 24 shuttles the working fluid back and forth from a cold side of the Stirling cooler 20, called a heat acceptor 28, to a warm side, called a heat rejecter 30. During expansion heat is absorbed at the heat acceptor 28, and during compression heat is rejected at the heat rejecter 30. The Stirling cooler 20 shown in FIG. 1 includes an absorber mass 34 at its lower portion, which is basically a mass spring system that balances the Stirling cooler. The absorber mass 34 absorbs the vibration of the oscillation of the displacer 24 and the piston 22 during operation.

Briefly described, the present invention utilizes the heat acceptor 28 (cold portion) of a Stirling motor (e.g., the Stirling cooler 20) to provide refrigeration or freezing in an insulated container. A variety of different configurations for the insulated container and for structures that utilize the heat acceptor 28 for refrigeration or freezing are described below.

In accordance with one aspect of the present invention, a structure, such as a heat sink, is provided on the heat rejecter 30 (hot portion) of the Stirling cooler 20 for dissipating heat that is generated during operation of the Stirling cooler. The structure is preferably arranged outside a compartment or compartments of the insulated container that are to be cooled, as is further described below.

Figure 2:
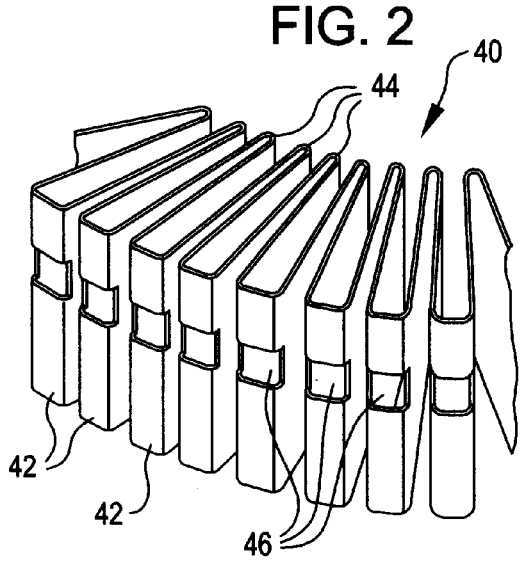
FIG. 2 is a partial cut-away perspective view of a wrap-around heat sink that may be used on a heat rejecter portion of the Stirling cooler of FIG. 1.

FIG. 2 shows a portion of a wrap-around heat sink 40 that may be used to dissipate heat that is generated at the heat rejecter 30. The wrap-around heat sink 40 in the embodiment shown is made of a corrugated metal strip, but may take any formation or may be formed of any suitable thermally-conductive material. The wrap-around heat sink 40 includes wide corrugations 42 at its perimeter, and narrow corrugations 44 at its interior. Indentations 46 are provided around the central portion of the outer surface of the wrap-around heat sink 40.

Figure 3:
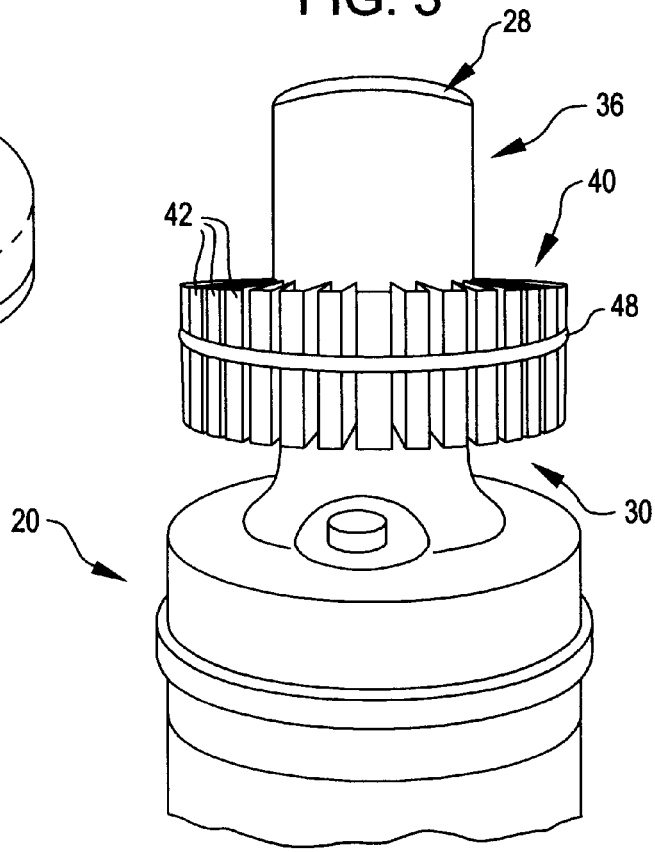
FIG. 3 is a partial cut-away perspective view showing the wrap-around heat sink of FIG. 2 installed on a heat rejecter portion of the Stirling cooler of FIG. 1.

When installed, the wrap-around heat sink 40 is located over the heat rejecter 30 of the Stirling cooler 20, as can be seen in FIG. 3. The narrow corrugations 44 fit against the sides of the regenerator 36. A thermal grease may be used at the connection of the heat rejecter 30 and the wrap-around heat sink 40 so that thermal conduction between the heat rejecter 30 and the wrap-around heat sink 40 is more effective. As is further described below, during operation, a fan may be used to help remove heat generated by the heat rejecter 30. The fan preferably blows over the wrap-around heat sink 40, and may be arranged to blow through or over the corrugations of the wrap-around heat sink 40.

As is known in the art, a heat sink such as the wrap-around heat sink 40 increases the surface area that is available for dissipating heat in a structure. The heat rejecter 30 is a very narrow band. The wrap-around heat sink 40 works particularly well because it focuses on the narrow heat rejecter 30 and increases the surface area of material that is thermally connected to the heat rejecter so that heat dissipation is more effective.

In accordance with one aspect of the present invention, a thermal transfer device is attached or otherwise associated with the heat acceptor 28 to remove heat through the heat acceptor from one or more compartments of the insulated cooler (i.e., the heat acceptor provides cooling of those compartments). For example, the thermal transfer device may include a heat sink that is connected with the heat acceptor 28 and that dissipates or spreads the cooler temperatures that are generated at the heat acceptor 28 (i.e., removes heat at the heat acceptor). As described further below, this heat sink may be used to dissipate the cooler temperatures that are generated at the heat acceptor 28, for example, into a compartment in an insulated container. In this manner, the heat sink removes heat from the compartment of the insulated container, and provides refrigeration for the compartment.

Figure 4:
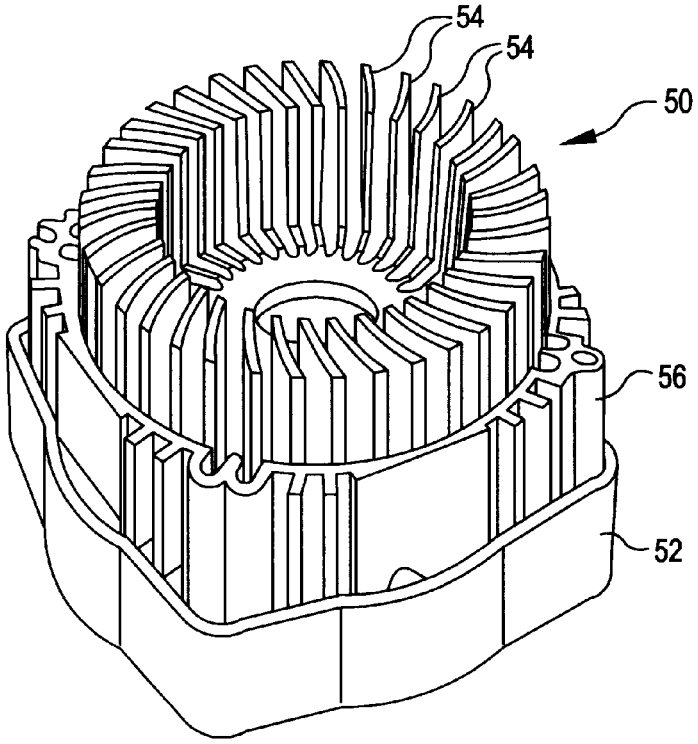
FIG. 4 is a perspective view of a heat sink and a fan that may be used on a heat acceptor portion of the Stirling cooler of FIG. 1.

Applicants have found that heat sinks that are produced for central processing units ("CPUs") and that are modified to fit the heat acceptor 28 work particularly well in dissipating the cooler temperatures that are generated at the heat acceptor 28. An example of such a heat sink 50 is shown in FIG. 4. The heat sink 50 may be, for example, a model produced by Power Cooler Enterprise Co. Ltd. in Taipei Hsien, Taiwan. Other heat sinks may be used, but the heat sinks designed to cool CPU's work particularly well because they are designed to dissipate 70 to 100 Watts of heat, whereas in one embodiment of the present invention, the heat acceptor 28 needs to dissipate less than 70 Watts of energy.

A fan 52 is mounted on a top portion of the heat sink 50 shown in FIG. 4. The fan 52 is configured to blow outward from the heat sink 50, but one or more fans may be arranged in other manners relative to a heat sink that is to be used with the heat acceptor 28, for example to blow across or downward through the heat sink.

The heat sink 50 includes convolute fins 54 that are arranged so that they extend around the heat acceptor 28. If a heat sink that is designed to fit on top of a CPU is used, the convolute fins 54 may have a core removed so that they may fit over the heat acceptor 28. Alternatively, the convolute fins 54 may simply be attached to the end of the heat acceptor 28. However, by having the convolute fins 54 fit over the heat acceptor 28, more thermal conduction is permitted, providing better dissipation of the cooler temperatures generated at the heat acceptor. The convolute fins 54 may be attached to the heat acceptor 28 by thermal grease or by other suitable means.

An upper skirt 56 is attached to the convolute fins 54. The upper skirt 56 provides further surface area for the heat sink 50, increasing heat dissipation. The upper skirt 56 and the convolute fins 54 are preferably both made of a highly thermally conductive metal, e.g., copper or aluminum, so that heat transfer between the heat acceptor 28 and the heat sink 50 is maximized.

Figure 5:
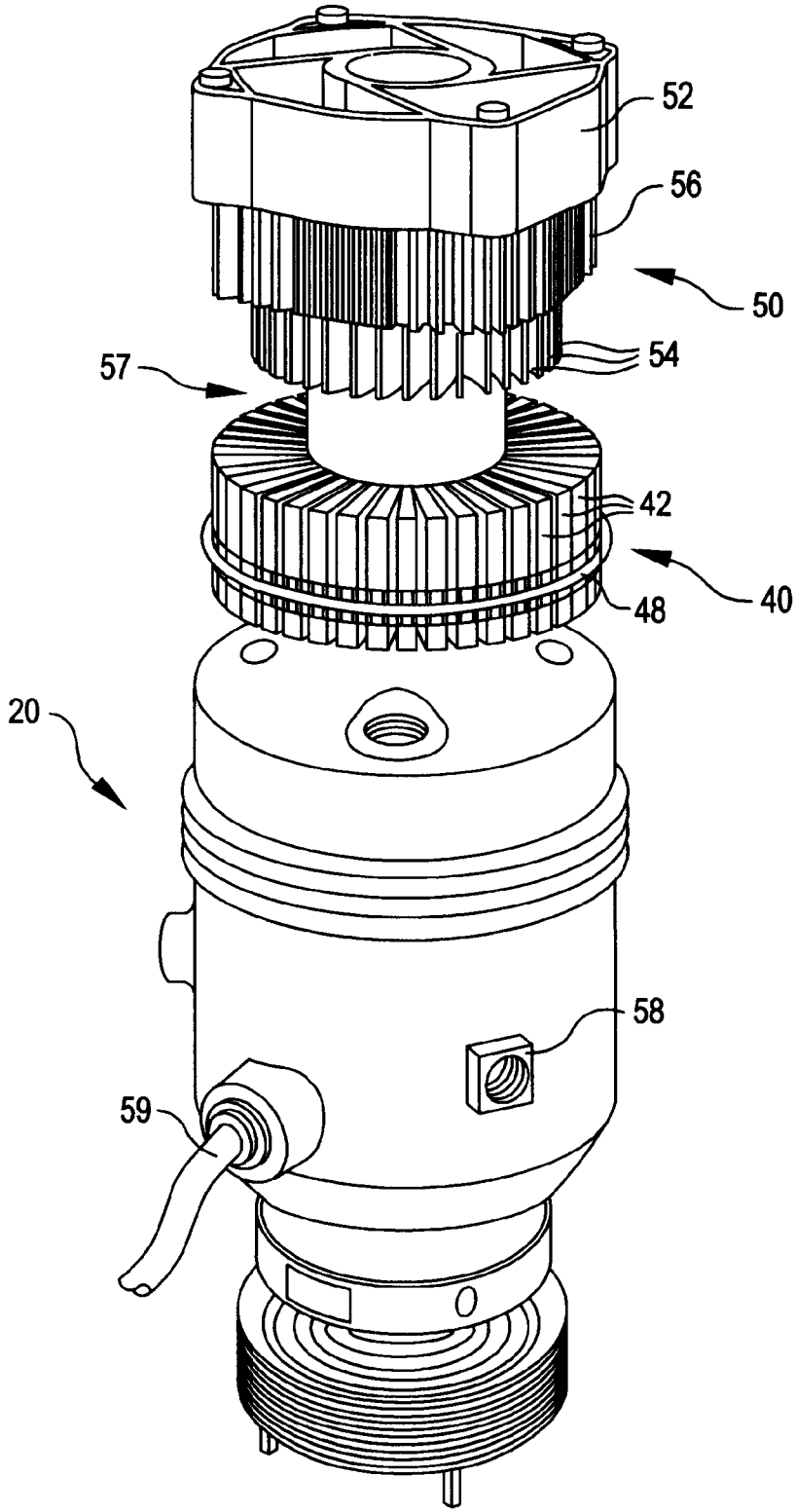
FIG. 5 shows the heat sink and fan of FIG. 4 installed on the Stirling cooler of FIG. 1.

FIG. 5 shows an assembled Stirling cooler 20, wrap-around heat sink 40, and heat sink 50. As can be seen, the arrangement and positioning of the wrap-around heat sink 40 and the heat sink 50 are such that a gap 57 is formed therebetween. In accordance with one aspect of the present invention, the heat sink 50 and the heat acceptor 28, and thus the cold-discharging portions of the Stirling cooler 20, are located above the gap 57. Below the gap 57 are the wrap-around heat sink 40 and the heat rejecter 30, i.e., the heat discharging components of the Stirling cooler 20. In addition, below the gap 57 is a charge port 58 for the Stirling cooler 20. The charge port 58 is where helium or another suitable working fluid is introduced into the Stirling cooler 20. The power supply (e.g., an AC wire) 59 is also located below the gap 57.

Figure 6:
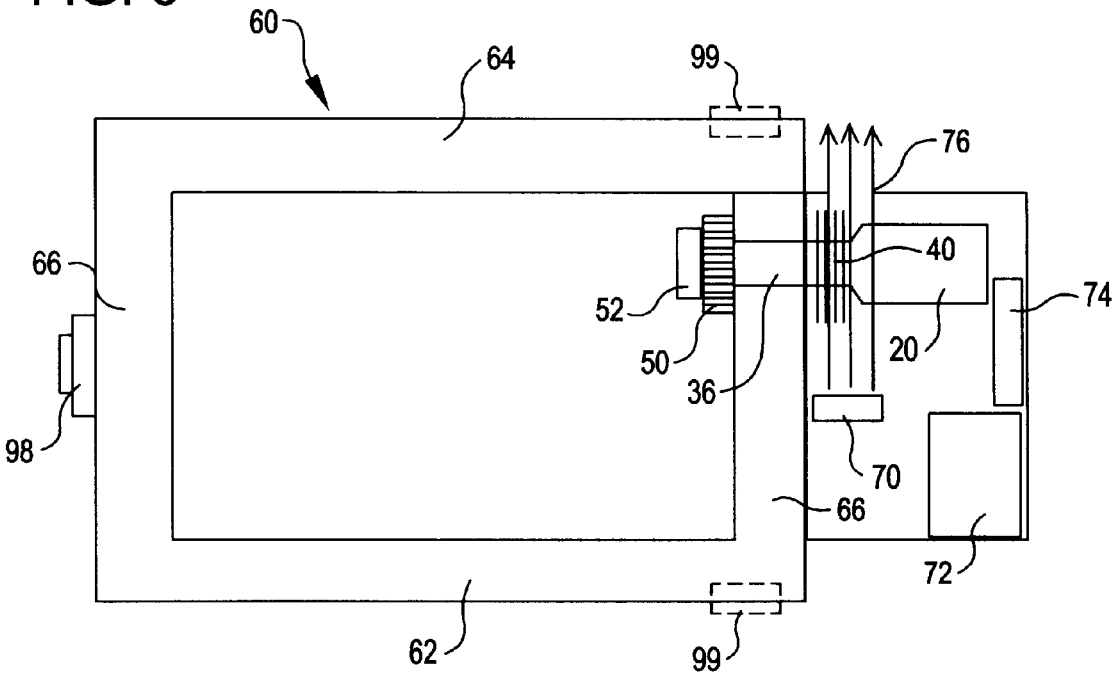
FIG. 6 is a schematic view of an insulated container having the Stirling cooler of FIG. 5 installed thereon.

FIG. 6 is a schematic representation of an insulated container 60 including the Stirling cooler 20, the heat sink 50, and the wrap-around heat sink 40. The insulated container 60 includes a front wall 62, a rear wall 64, a left side wall 66, and a right side wall 68. The insulated container may include insulation formed, for example, of polyurethane, high-impact polystyrene, polypropylene, ABS, polyethylene, or another suitable high-impact thermoplastic insulating material. The insulation preferably has sufficient thermal insulating qualities so that an insignificant amount of heat is lost though the sides and top of the insulated container 60. Preferably a lid for the insulated container 60 is well-fitted, and is sealed with an o-ring and a lock such as is known in the art. Such a structure minimizes heat loss that otherwise might occur through the closure for the lid.

The Stirling cooler 20 may be mounted through one of the walls 62, 64, 66, 68, or through a top or bottom of the cooler. In the example shown, the Stirling cooler 20 is mounted through the right side wall 68. A hole (not shown) in the right side wall 68 is provided for this purpose, and is sized so that the hole fits tightly around the regenerator 36 and is aligned with the gap 57. In accordance with one aspect of the present invention, the heat sink 50 and the heat acceptor 28 are mounted inside the compartment that is to be cooled in the insulated container 60, and the wrap-around heat sink 40 and the heat rejecter 30 are mounted outside the cooled compartment.

A fan 70 is positioned to blow air across the wrap-around heat sink 40. The fan 70 may be mounted in an enclosure 71 that is attached to the side of the insulated container 60. The enclosure 71 may also house the Stirling cooler 20. Although the fan 70 is shown as blowing air across the heat sink 40, the fan 70 may be alternatively arranged so that it faces outward (i.e., out of a hole 76 on the side of the enclosure 71), so that the fan may draw heat out of the enclosure 71.

If desired, the heat dissipated at the wrap-around heat sink 40 may be used to warm or heat the enclosure 71. In such an embodiment, the enclosure 71 may also be insulated to prevent the loss of heat. The heated enclosure 71 may be used for the storage of items that need to remain warm or heated.

The arrangement shown in FIG. 6 is advantageous in that the cooling components of the Stirling cooler 20, i.e., the heat sink 50 and the heat acceptor 28, are located inside the compartment to be cooled. That is, the components are located within the insulated container 60. In contrast, the heated portions of the Stirling cooler 20, i.e., the heat rejecter 30 and the wrap-around heat sink 40 are located outside the compartment to be cooled, although they may be inside the insulated container 60, for example in the enclosure 71. In addition, the charge port 58, the AC wires 59, a battery 72 for the Stirling cooler 20, and a control box 74 for the Stirling cooler 20 may all be mounted outside the compartment to be cooled, but may be mounted inside the enclosure 71. An opening 76 may be provided on the side of the enclosure 71 to allow the escape of hot air that has been vented by the fan 70 over the wrap-around heat sink 40. Alternatively, if the enclosure 71 is used as a warmed compartment, then the opening may not be provided. In another embodiment, a separate warming compartment may be arranged outside the opening 76, and the heat blown through the opening may be used to warm the separate compartment.

By structurally separating the heat producing components of the Stirling cooler 20 from the cooler air producing components, the cool air from the heat sink 50 and the heat acceptor 28 is provided to the refrigerated interior portion of the insulated container 60, and heat is directed away from the refrigerated portion, e.g., by the fan 70 and out the hole 76 (or in the enclosure 71). Moreover, the fan 70, the battery 72, the control box 74, and the charge port 58 may all be easily accessed without having to open cooled portion of the insulated container 60. If the enclosure 71 is used as a warm compartment, then the right wall 66 of the insulated container 60 separates the colder portions of the Stirling cooler from the warm compartment.

FIG. 7 shows an alternate embodiment in which the Stirling cooler 20 is used to create a freezer in an insulated container 80. In accordance with the embodiment shown in FIG. 7, the thermal transfer device includes a thermosyphon 82. The thermosyphon 82 is used to transfer cold fluid from the heat acceptor 28 into a freezer compartment 84 for the insulated container 80. The thermosyphon 82 may alternatively be a heat pipe.

The function and operation of heat pipes and thermosyphons are well known, but a brief description is given here for the benefit of the reader. In general, a heat pipe or thermosyphon includes a working fluid constantly flowing along its length. For a thermosyphon (e.g., such as the thermosyphon 82 of FIG. 7), cooled liquid leaves a cooling source (e.g., the heat acceptor 28 in the present invention), and flows through the pipe, downward and then back up to the cooling source. The liquid evaporates on its travel through the downward portion of the loop, as it absorbs heat from inside the insulated container. The fluid often turns completely into a vapor before it has returned to the cooling source. The vapor is then condensed at the cooling source, and starts downward again, repeating the cycle. The flow of liquid downward keeps the fluid moving in the system, without moving parts. The thermosyphon 82 is maintained at close to the same temperature as the cooling source, and in the present invention may be used to cool or freeze the interior of the freezer compartment 84. A heat pipe works in a similar manner, but utilizes a wick that provides capillary pumping of the fluid, instead of gravity, to move the fluid through the pipe.

The fluid in the thermosyphon may need to be pressurized so that as the fluid flows through the lower portion of the loop, it is vaporized. For the embodiment shown in FIG. 7, the thermosyphon 82 is arranged in a serpentine path internally along one side of the freezer compartment 84. The thermosyphon 82 is attached to the heat acceptor 28, which, along with the rest of the Stirling cooler 20, is mounted outside the freezer compartment 84 (e.g., in a separate enclosure). The Stirling cooler 20 is upright in the embodiment shown, so that the heat acceptor 28 is arranged to enhance the thermosyphon effect. However, the Stirling cooler 20 may be arranged in other configurations, for example horizontally, or may even be upside down. A fan 70 may be used for cooling of the wrap-around heat sink 40.

The thermosyphon 82 may be attached to the heat acceptor 28 in a suitable manner, such as by welding or by use of thermal grease or thermal glue. The thermosyphon 82 is arranged so that fluid leaves the heat acceptor 28, travels through a hole in the side of the freezer compartment 84, and flows downward along the serpentine path to the bottom of the freezer compartment, out another hole in the wall of the freezer compartment, and then back up to the heat acceptor 28. Fluid within the thermosyphon 82 condenses and turns into a liquid when in close proximity to the heat acceptor 28, and evaporates and turns into a vapor as it flows down the serpentine path of the thermosyphon 82 and returns to the heat acceptor 28.

The thermosyphon 82 provides a constant flow of moving fluid without moving parts. The evaporation and condensation of the fluid in the thermosyphon 82 provides the work for continuous movement of the fluid. The fluid may be, for example, carbon dioxide, argon, benzene, alcohol, or water. The cool fluid in the thermosyphon 82 provides sufficient thermal conduction within the freezer compartment 84 of the insulated container 80 so that that compartment may be maintained at temperatures sufficient for freezing of foods or other items within the compartment.

If desired, a metallic liner 86 (FIG. 8) may be provided to enhance heat transfer within the freezer compartment 84. Using a metallic liner 86 with a heat pipe or thermosyphon is not required, but using a metallic liner may increase heat transfer within the freezer compartment 84. The metallic liner 86 may be formed of any suitable thermally-conductive material, for example aluminum, 1/16 to 1/8 inch thick. In addition, while the metallic liner 86 is shown in FIG. 8 as extending around the freezer compartment 84, it may alternatively only extend only part way around the freezer compartment 84, or may extend along the wall in which the thermosyphon 82 is arranged.

The thermosyphon 82 may be attached to the metallic liner 86, for example by welding or thermal grease. Alternatively, in accordance with one aspect of the present invention, the insulated container may be formed around the thermosyphon 82 and the metallic liner 86. A foaming process for the insulated container causes the thermosyphon 82 to be wedged against the inside edge of the metallic liner 86. As shown in FIG. 12, the metallic liner 86 is placed against the thermosyphon 82, and foam is inserted between an outer shell 95 of the insulated container and the metallic liner. The foam is shown as being inserted through a hole in the bottom of the shell 95, but may be inserted from other locations.

The foam hardens inside the shell and the metallic liner 86, and locks the thermosyphon 82 into position. This process yields a structure where the metallic liner 86 fully contacts the thermosyphon 82, the thermosyphon is not exposed on the inside of the insulated container, and the metallic liner lines the inside of the container. Mechanical attachment of the thermosyphon 82 and the metallic liner 86 is not needed, because the thermosyphon is pressed against the metallic liner during the foaming process, and is held in place in that position after foaming is complete.

By encapsulating the thermosyphon 82, the inside of the insulated container 80 is easier to clean. Moreover, because the metallic liner 86 is exposed to the interior of the compartment 84, thermal transfer to the inside of the compartment is enhanced.

Although the metallic liner 86 may be fully exposed on the inside of the compartment 84, in accordance with another aspect of the present invention, a liner 94 (FIG. 12) may be provided on the inside surface of the metallic liner 86. The liner 94 may be, for example, a thermally conductive plastic, or a thin coating of another suitable plastic. The liner 94 may be used to provide a smooth transition between the metallic liner 86 and the walls of the insulated container, eliminating juncture lines where dirt or grime may be trapped.

Figure 9:
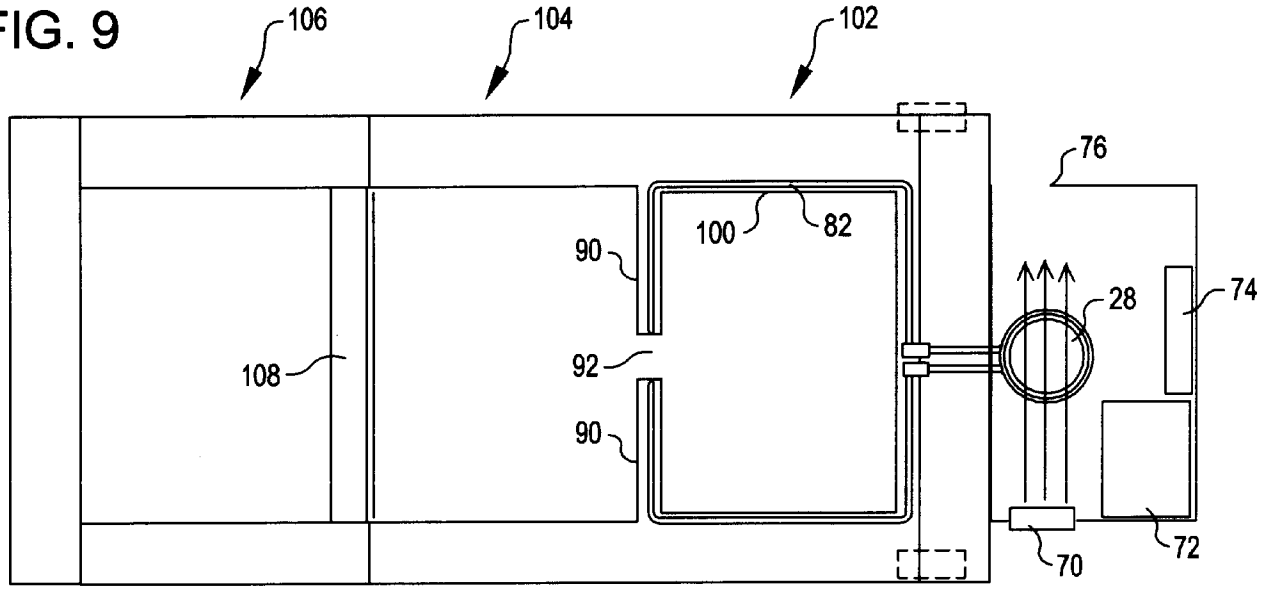
FIG. 9 is a schematic top view of an alternate embodiment of an insulated container that is similar to the insulated container shown in FIG. 8.

An alternate embodiment of a metallic liner 100 is shown in FIGS. 9 and 10. The metallic liner 100 extends around only a bottom portion of a freezer compartment 102. In still another embodiment, the freezer liner 100 may extend around only a top portion of the freezer compartment 84. For the embodiment shown in FIGS. 9 and 10, the heat pipe or thermosyphon 82 that is connected to the heat acceptor 28 extends around the metallic liner 100. Alternatively, the heat pipe or thermosyphon may extend along only one side, such as is in the embodiment of FIG. 7. Extending the thermosyphon along only one side reduces construction costs (i.e., less thermosyphon is needed and thermosyphon does not have to be incorporated about the perimeter of the insulated container).

In accordance with one aspect of the present invention, the insulated container 80 in FIGS. 7 and 8 includes not only the freezer compartment 84, but also a refrigerator compartment 88. The refrigerator compartment 88 is separated from the freezer compartment 84 by a barrier wall 90 (FIG. 8). The barrier wall 90 may include insulation that has similar insulating qualities to the side walls of the insulated container 80, or may include a thinner insulation that allows some thermal convection through its walls. If the thinner insulation is used, cool air in the freezer compartment 84 may flow (through convection) into the refrigerator compartment 88, providing sufficient cooling for refrigeration.

In addition to thinner insulation, or instead of thinner insulation, an opening 92 may be provided in the barrier wall 90 between the freezer compartment 84 and the refrigerator compartment 88. The opening 92 may be, for example, a circular hole with a diameter of ½ inch or smaller. The opening 92 permits the flow of cooler air from the freezer compartment 84 into the refrigerator compartment 88, thus providing sufficient cool air for refrigeration.

The opening 92 may be a fixed diameter, or may include a device which permits the size of the opening to be changed. For example, as shown in FIG. 13, louvers 96 may be mounted over the opening 92 so that airflow through the opening may be increased or decreased as desired. Rotating the louvers 96 causes the opening to be more or less covered. The louvers 96 may be moved manually, or may be moved by automation. For example, the cover 96 may be connected to a servomotor 97 that rotates the cover upon actuation. The servomotor may operate the louvers 96 between opened and closed positions, and control for the servomotor 97 may be a switch or may be thermostat driven.

If desired, if a thermosyphon 82 is used for the thermal transfer device, a small part of the thermosyphon may extend into and through a portion of the refrigerator compartment 88. The amount that the thermosyphon 82 extends through the refrigerator compartment 88 may be varied to provide different levels of cooling to the refrigerator compartment.

In the embodiment shown in FIGS. 9 and 10, in addition to a freezer compartment 102 and a refrigerator compartment 104, a dry section 106 (i.e., no refrigeration or freezing) is provided. This dry section 106 is separated from the other sections by an additional barrier wall 108. The dry section 106 is not provided cooling or warming, and may be used, for example, for the storage of fish tackle, clothes, or other items.

Figure 11:
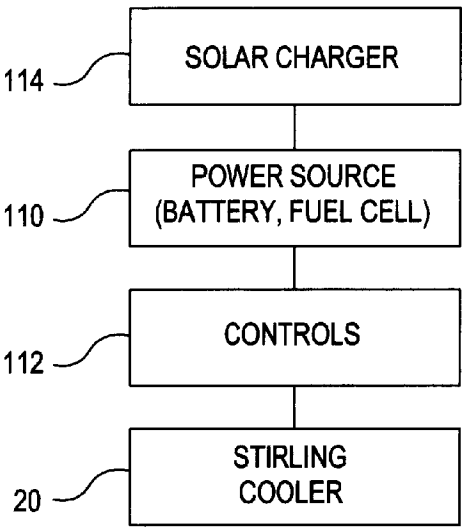
FIG. 11 shows a schematic diagram for the circuitry for the Stirling cooler of FIG. 1 in accordance with one aspect of the present invention.

FIG. 11 shows a schematic diagram of the circuitry for the Stirling cooler 20. This same circuitry may be used for either the refrigerator embodiments or freezer embodiments described herein. In the circuitry, a power source 110, such as a solar panel, a battery, or an AC power supply, is attached to controls 112, which in turn are attached to the Stirling cooler 20.

The power source 110 may be one of many different sources for power, including solar or battery. Preferably, the power source 110 is portable so that the insulated container utilizing the Stirling cooler 20 does not have to be near an AC outlet. Moreover, the power source 110 is preferably self-contained (i.e., mounted on or in the insulated container). This feature permits the insulated container to be fully portable, for example by grasping a handle 98 (FIG. 6) and pulling the insulated container on wheels 99. Because the power source 110 is self-contained, the refrigeration components of the insulated container are operational during movement and when stationary.

Applicants have determined that an average of only 11 Watts of power are required as input for the Stirling cooler 20 to have a corresponding output of 40 Watts of cooling at the heat acceptor 28. The 11 Watts of power may be provided, for example, by a rechargeable 12 volt battery. Alternatively, a fuel cell may be used to power the Stirling cooler 20. The fuel cell may be, for example, a 50 to 60 Watt fuel cell such as is sold by Energy Related Devices, Inc. of Los Alamos, N.Mex.

A solar panel 114 may be mounted on the top of an insulated container such as is shown in FIG. 7. Alternatively, the solar panel may be mounted anywhere on the insulated container where it may be exposed to light. The solar panel 114 may be, for example, lightweight, flexible solar modules for photovoltaic applications, such as are made by Iowa Thin Film Technologies, Inc. The solar modules are created on a thin plastic substrate allowing the completed modules to be as thin and lightweight as a sheet of paper. The extreme flexibility of the modules allows them to conform to a wide variety of surfaces and to be easily mounted on existing products.

In accordance with one aspect of the present invention, the solar modules are incorporated into a lid of an insulated container (e.g., the lid 120 of the insulated container 80, for example by suitable adhesive bonding techniques. The solar modules may cover the entire lid, or may be inset in a portion of the lid. If mounted in the lid 120, then wires may extend down from the lid 120 into the cooler.

The solar panel 114 may serve as the power source for the Stirling cooler 20. In an alternate embodiment, shown in FIG. 11, the solar panel 114 may be used as a battery charger, charging the batteries 110 during the day. Alternatively, the solar panels could be used both to power the Stirling unit and thus provide refrigeration and/or freezing for the cooler and charge a battery for nighttime operations.

The features of the solar panel 114 may be utilized with the Stirling cooler 20 or another refrigeration unit for an insulated container. One advantage to the use of the solar panel 114, especially if the solar panel covers the outside of the insulated container, is that the insulated container 80 may be left in the sun without risk of losing its cooling effect. In fact, direct sun may increase power that is available for the operation of the Stirling cooler 20 or other refrigeration unit.

The controls 112 may be an analog device as simple as an On/Off switch, or may be a microcontroller for controlling the operation of the Stirling cooler 20. The controls may be any device or mechanism used to regulate or guide the operation of the Stirling cooler 20 and/or its components, or may be a device that can execute computer-executable instructions, such as program modules. Generally, program modules include routines, programs, objects, components, data structures and the like that perform particular tasks or implement particular abstract data types. In one embodiment, the controls 112 may provide regulation of the speed of reciprocation of the piston 22 for the Stirling cooler 20. As such, the controls 112 would provide an adjustment to the temperature of the heat acceptor 28. In this manner, the temperature provided by the Stirling cooler 20 may be adjusted.

In one embodiment of the present invention, a single compartment in an insulated container may function either as a freezer or a refrigerator based upon the temperature supplied by the Stirling cooler 20. In such an embodiment, the controls 112 may include a switch that allows the operation of the Stirling cooler 20 to be changed between the freezer and refrigerator modes. In the freezer mode, the piston 22 would oscillate faster than in the refrigerator mode. The speeds needed for freezer verses refrigerator operation may be determined empirically, and may be set in a manner in accordance with the trade.

The controls 112 may also include a thermostat connected with one or more of the compartments of an insulated container. Such a thermostat provides information to the controls 112 that permit the controls 112 to adjust the power input to the Stirling which then adjusts the speed of the piston 24 in the Stirling cooler 20 according to the levels set by the user. That is, if the temperature is too low, the Stirling cooler 20 is slowed down, and if the temperature is too high the Stirling cooler 20 is sped up.

As an alternative to the thermosyphon 82 or the heat sink 50, the heat acceptor 28 may be used with other thermal transfer devices. For example, the heat acceptor may be connected directly to a metallic liner (e.g., the metallic liner 86) within a freezer or refrigerator compartment for an insulated container. In such an embodiment, for example, the heat acceptor 28 may extend through a side wall of the insulated container and may be welded or otherwise connected to a metallic liner. Other structures may be used for dissipating the colder temperatures produced by the heat acceptor 28 into an insulated container.

In summary, the present invention provides a portable refrigerator or freezer that requires very little power for operation. The combined components of the insulated container and the Stirling motor may weigh as little as 20 pounds or less, permitting the insulated container to be easily carried by one or two individuals, or wheeled around on wheels attached to the insulated container.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. An insulated container, comprising:

a first compartment;

a second compartment;

a Stirling cooler having a heat rejecter and a heat acceptor;

a thermal transfer device configured and arranged to draw heat via the heat acceptor from the first and second compartments; and a power source connected to the Stirling cooler for providing power thereto, the power source being fully contained with the insulated container.

2. The insulated container of claim 1, wherein the power source comprises a battery.

3. The insulated container of claim 2, further comprising a solar panel connected to the battery and configured to recharge the battery.

4. The insulated container of claim 3, wherein the solar panel comprises solar modules connected to an outside surface of the insulated container.

5. The insulated container of claim 4, wherein the solar modules are integrated into a lid for the insulated container.

6. The insulated container of claim 1, wherein the power source comprises a fuel cell.

7. The insulated container of claim 1, wherein the power source comprises a solar panel.

8. The insulated container of claim 7, wherein the solar panel comprises solar modules connected to an outside surface of the insulated container.

9. The insulated container of claim 8, wherein the solar modules are integrated into a lid for the insulated container.

10. The insulated container of claim 1, wherein the heat acceptor is mounted on the interior of the first compartment.

11. The insulated container of claim 1, wherein the thermal transfer device comprises a heat sink mounted on the heat acceptor, and a fan positioned to draw air through the heat sink and into the first compartment.

12. The insulated container of claim 1, wherein the heat rejecter is mounted on the outside of the insulated container.

13. The insulated container of claim 12, wherein the heat rejecter is mounted in a third compartment, and further comprising an opening in the third compartment arranged to allow the escape of heat.

14. The insulated container of claim 13, further comprising a fan positioned to remove heat from the heat rejecter and direct the heat out of the opening.

15. The insulated container of claim 1, wherein the thermal transfer device comprises at least one of a heat pipe or a thermosyphon.

16. The insulated container of claim 15, wherein the at least one of a heat pipe or a thermosyphon is connected to the heat accepter, routed into the first compartment, and extends in a serpentine path along an interior wall of the first compartment.

17. The insulated container of claim 1, wherein the first compartment is cooled by the heat acceptor and the thermal transfer device a sufficient amount to function as a freezer, and wherein the second compartment is cooled by the heat acceptor and the thermal transfer device a sufficient amount to function as a refrigerator.

18. The insulated container of claim 17, wherein the first compartment is cooled by the heat acceptor and the thermal transfer device, and wherein the second compartment is cooled by the first compartment.

19. The insulated container of claim 18, wherein the second compartment is cooled by air flowing through an opening between the first compartment and the second compartment.

20. The insulated container of claim 19, further comprising a device for selectively closing a part of the opening.

21. The insulated container of claim 20, wherein the device comprises louvers.

22. The insulated container of claim 21, wherein the louvers are driven by a motor.

23. The insulated container of claim 18, further comprising a divider between the first compartment and the second compartment, and wherein the second compartment is cooled by convection through the divider.

24. The insulated container of claim 1, further comprising a handle connected to the insulated container and for transporting the insulated container.

25. The insulated container of claim 1, further comprising a third compartment heated by the heat rejecter.

26. An insulated container, comprising:

a first compartment;

a second compartment;

a Stirling cooler having a heat rejecter and a heat acceptor; and a thermal transfer device attached to the heat acceptor configured and arranged to draw heat from the first compartment and the second compartment via the heat acceptor, the thermal transfer device being arranged at an end of the first compartment away from the second compartment.

27. The insulated container of claim 26, wherein the thermal transfer device comprises at least one of a heat pipe or a thermosyphon.

28. The insulated container of claim 27, wherein the at least one of a heat pipe or a thermosyphon is connected to the heat accepter, routed into the first compartment, and extends in a serpentine path along an interior of the end of the first compartment.

29. The insulated container of claim 28, wherein the first compartment is cooled by the heat acceptor and the thermal transfer device a sufficient amount to function as a freezer, and wherein the second compartment is cooled by the first compartment a sufficient amount to function as a refrigerator.

30. The insulated container of claim 29, wherein the second compartment is cooled by air flowing through an opening between the first compartment and the second compartment.

31. The insulated container of claim 30, further comprising a device for selectively closing a part of the opening.

32. The insulated container of claim 31, wherein the device comprises louvers.

33. The insulated container of claim 32, wherein the louvers are driven by a motor.

34. The insulated container of claim 29, further comprising a divider between the first compartment and the second compartment, and wherein the second compartment is cooled by convection through the divider.

35. The insulated container of claim 26, further comprising a handle connected to the insulated container and for transporting the insulated container.

36. The insulated container of claim 26, further comprising a third compartment heated by the heat rejecter.

37. An insulated container, comprising:

a Stirling cooler having a heat rejecter and a heat acceptor;

a thermal transfer device configured and arranged to draw heat from the first compartment via the heat acceptor;

a first compartment cooled by the heat acceptor and the thermal transfer device a sufficient amount to function as a freezer; and a second compartment cooled by the heat acceptor and the thermal transfer device a sufficient amount to function as a refrigerator.

38. The insulated container of claim 37, wherein the thermal transfer device comprises at least one of a heat pipe or a thermosyphon.

39. The insulated container of claim 38, wherein the at least one of a heat pipe or a thermosyphon is connected to the heat accepter, routed into the first compartment, and extends in a serpentine path along an interior wall of the first compartment.

40. The insulated container of claim 37, and wherein the second compartment is cooled by the first compartment.

41. The insulated container of claim 37, wherein the second compartment is cooled by air flowing through an opening between the first compartment and the second compartment.

42. The insulated container of claim 41, further comprising a device for selectively closing a part of the opening.

43. The insulated container of claim 42, wherein the device comprises louvers.

44. The insulated container of claim 43, wherein the louvers are driven by a motor.

45. The insulated container of claim 37, further comprising a divider between the first compartment and the second compartment, and wherein the second compartment is cooled by convection through the divider.

46. The insulated container of claim 37, further comprising a second compartment heated by the heat rejecter.

47. An insulated container, comprising:

a refrigeration unit for cooling at least one compartment in the insulated container, the refrigeration unit comprising a Stirling cooler having a heat rejecter and a heat acceptor, and a thermal transfer device configured and arranged to draw heat from the first compartment via the heat acceptor;

a lid; and a solar panel mounted integrally on the lid and forming a portion of an outer surface the lid and configured to supply power for the refrigeration unit.

48. An insulated container, comprising:

a refrigeration unit for cooling at least one compartment in the insulated container;

a lid; and a solar panel mounted integrally on the lid and forming a portion of an outer surface the lid and configured to supply power for the refrigeration unit, the solar panel comprising solar modules mounted on the lid so as to form the portion of the outer surface of the lid.

49. An insulated container, comprising:

a refrigeration unit for cooling at least one compartment in the insulated container;

a battery for powering the refrigeration unit;

a lid; and a solar panel mounted integrally on the lid and forming a portion of an outer surface the lid and configured to supply power for the refrigeration unit, the solar panel being configured to recharge the battery.

50. The insulated container of claim 49, wherein the solar panel comprises solar modules mounted on the lid so as to form the portion of the outer surface of the lid.

51. A method for forming an insulated container, comprising:

aligning at least one of a thermosyphon and a heat pipe inside a shell;

aligning a metallic liner along the least one of a thermosyphon and a heat pipe and opposite the shell;

injecting foam between the metallic liner and the shell; and allowing the foam to harden so as to capture the at least one of a thermosyphon and a heat pipe against the metallic liner.

52. The method of claim 51, further comprising attaching the at least one of a thermosyphon and a heat pipe against the metallic liner to a Stirling cooler.

* * * * *